US006098199A

United States Patent [19]

Barkin

[11] Patent Number: 6,098,199

[45] Date of Patent: Aug. 8, 2000

[54] NON-SLIP HANDLE INTERFACE

[76] Inventor: Andrew J. Barkin, 3527 Haven Ave., Menlo Park, Calif. 94025

[21] Appl. No.: 08/998,460

[22] Filed: Dec. 26, 1997

[51] Int. Cl.[7] ..... A41D 19/00; A63B 71/14

[52] U.S. Cl. ..... 2/159; 2/161.3; 2/161.8; 74/551.8; 473/205

[58] Field of Search ..... 2/158, 159, 160, 2/161.1, 161.2, 161.3, 161.8, 167, 168; 74/551.8–551.9, 558.5; 473/300, 205, 201

[56] References Cited

U.S. PATENT DOCUMENTS

| | | | |
|---|---|---|---|
| 2,327,836 | 8/1943 | Willard | 2/159 |
| 4,316,926 | 2/1982 | Kaminstein | 428/137 |
| 4,400,831 | 8/1983 | Rietz | 2/161.1 |
| 5,135,226 | 8/1992 | Place | 273/166 |
| 5,164,231 | 11/1992 | Davis | 427/256 |
| 5,232,225 | 8/1993 | Snyder | 273/187.2 |
| 5,491,015 | 2/1996 | Reeves et al. | 428/167 |
| 5,511,248 | 4/1996 | Widdemer | 2/161.3 |
| 5,611,533 | 3/1997 | Williams | 473/568 |
| 5,625,900 | 5/1997 | Hayes | 2/161.8 |
| 5,742,941 | 4/1998 | Porter | 2/161.4 |

FOREIGN PATENT DOCUMENTS

| | | | |
|---|---|---|---|
| 2807658 | 9/1979 | Germany | 2/161.1 |

*Primary Examiner*—Michael A. Neas
*Attorney, Agent, or Firm*—John Schipper

[57] ABSTRACT

Apparatus for providing an enhanced grip between a gloved hand and a handle or other object to be gripped. A portion or all of the glove and a portion or all of the handle are provided with selected first and second gripping surfaces, respectively, of the same or different materials, that join together, temporarily or permanently, and provide a stronger hand-to-handle grip that resists slipping. Alternatively, a flexible band, having second and third gripping surfaces on opposite sides, is wrapped around a first object that is to be rotated or otherwise moved relative to a second object, such as a lid and a jar. A gloved hand, having a first gripping surface, grips the flexible band and the first object and forms a strong temporary join between hand, flexible band and first object, allowing the first object to be more easily moved. Various thermoplastic, amorphous polymers, crystalline polymers and rubber-like materials can be used for the gripping surfaces. The invention has application to construction, maintenance, control and extraction work, to sports activities, to repair work around the home and to persons suffering from arthritis and similar diseases that affect an ability to grip an object.

14 Claims, 2 Drawing Sheets

NON-SLIP HANDLE INTERFACE

FIELD OF THE INVENTION

This invention relates to design of a glove or other hand covering and of a handle or object covering that receives or mates with the glove.

BACKGROUND OF THE INVENTION

In many sports activities and work activities, a glove or other hand covering is worn on one hand or on each hand of a user to protect the user's hand(s) and/or to provide a firmer grip or purchase of the hand against a handle that is gripped by the hand. The handle to be gripped may be that of a golf club, of a baseball or cricket bat, of a racquet for tennis, squash or badminton, or work apparatus, such as a hammer, hatchet or saw, or even of a driver's wheel for an automotive or motorcycle vehicle.

Several workers in this field have disclosed gloves or other single-surface interfaces to protect the hand or to provide a more certain grip of a hand or similar item against another surface, in the following U.S. Patents:

U.S. Pat. No. 3,649,967, issued to Millman, U.S. Pat. No. 4,012,039, issued to Yerke, U.S. Pat. No. 4,030,150, issued to Fisher, U.S. Pat. Nos. 4,053,676 and 4,316,926, issued to Kaminstein, U.S. Pat. No. 4,387,895, issued to Steel, U.S. Pat. No. 4,396,013, issued to Hasslinger, U.S. Pat. No. 4,533,139, issued to Goldin et al, U.S. Pat. No. 4,552,713, issued to Cavicchioli, U.S. Pat. No. 4,613,537, issued to Krupper, U.S. Pat. No. 4,651,991, issued to McDuff, U.S. Pat. No. 4,754,499, issued to Pirie, U.S. Pat. No. 5,035,428, issued to Bartkowicz, U.S. Pat. No. 5,055,340, issued to Matsumura, U.S. Pat. No. 5,060,943, issued to Stoffo, U.S. Pat. No. 5,350,343, issued to Da Silva, U.S. Pat. No. 5,443,172, issued to Gabriele, U.S. Pat. No. 5,467,484, issued to Drescher et al, U.S. Pat. No. 5,482,270, issued to Smith, U.S. Pat. No. 5,482,993, issued to Hiraoka, U.S. Pat. No. 5,511,248, issued to Widdemer, U.S. Pat. No. 5,524,885, issued to Heo, U.S. Pat. No. 5,584,096, issued to Aurora, U.S. Pat. No. 5,556,092, issued to Theken, U.S. Pat. No. 5,604,934, issued to Willett, U.S. Pat. No. 5,621,931, issued to Hamilton, U.S. Pat. No. 5,624,738, issued to Barbeau et al, and U.S. Pat. No. 5,644,795, issued to Landis et al.

These patents disclose provision of one surface, usually as part of a glove or other hand covering, that provides a grip or purchase that is either non-slip or that has a surer grip. If the surface of the handle or other item that is to be gripped by the glove is smooth, slippery or very moist, the non-slip grip may be of little value, because the non-slip grip surface has no opportunity to make firm contact with the other surface. What is needed is an interface system that is optimized for a group of sports-related or work-related activities and that can be changed, if necessary, when the user moves from one activity to another.

SUMMARY OF THE INVENTION

These needs are met by the invention, which provides an interface system that includes (1) a first gripping surface, worn on a glove or other hand covering and (2) a second gripping surface, fitted to a handle or other sports or work apparatus that receives the gloved hand, where the first gripping surface is optimized for use with a group of second gripping surfaces, such as second gripping surfaces that appear on handles of tennis racquets, squash racquets and badminton racquets. The second gripping surface for the particular handle is selected to provide surer gripping and to provide optimum response for the activity in which the handle will be used. The first and second gripping surfaces may be, but need not be, the same, depending upon the group of activities in which the gripping surfaces will be used. The second gripping surface may be removable so that the handle can be used without a special gripping surface, or with several different surfaces. The first gripping surface may be changed by replacing one glove by another.

First and second gripping surfaces, as used in the invention, can be applied in a work environment, on a handle or other grip surface of a hammer, hatchet, saw, construction tool or similar item, in a sports environment, on a handle or other grip surface of a golf club, tennis, or badminton racquet, bat or similar item, or in everyday use as an aid to a person with arthritis or other affliction that affects gripping.

The glove can also be applied to mittens, in which two or more fingers do not have separate finger coverings. For example, certain diving gloves have a first covering for the thumb, a second covering for the first and second index fingers, and a third covering for the third and fourth index fingers. This design is intended to provide some finger dexterity while minimizing the finger areas that is exposed to the very cold water that is present at great depths.

DESCRIPTION OF BEST MODE OF THE INVENTION

Figure 1:
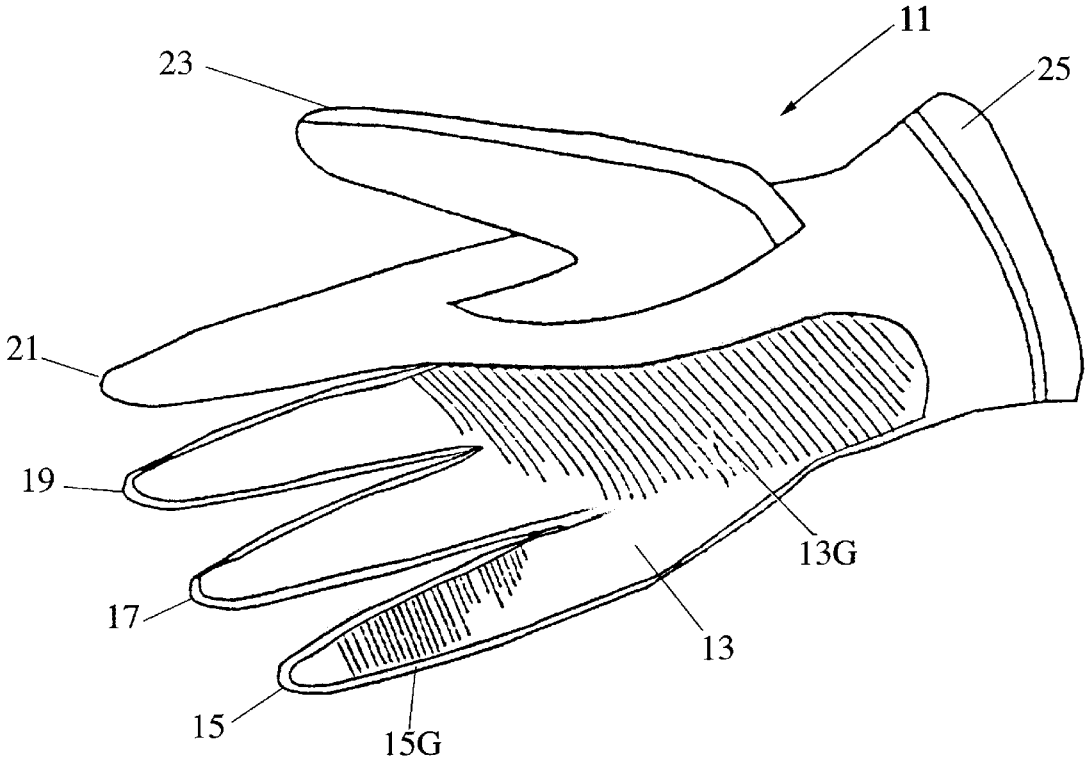
FIGS. 1 and 2 shows an embodiment of a glove, constructed according to the invention.

FIG. 1 illustrates a glove 11 constructed using the invention. The glove 11 includes a palm region 13, four or fewer finger coverings (two or three, if desired) 15, 17, 19 and 21, a thumb covering 23, and a cuff region 25. A substantial portion of the palm region 13 is covered with a first material M1 that provides a first gripping surface, shown shaded in FIG. 1. Two or more of the finger coverings 15, 17, 19 and 21 are also covered with the material M1 to form a first gripping surface, for example the regions 13G and 15G on the palm region 13 and finger covering 15.

Figure 2:
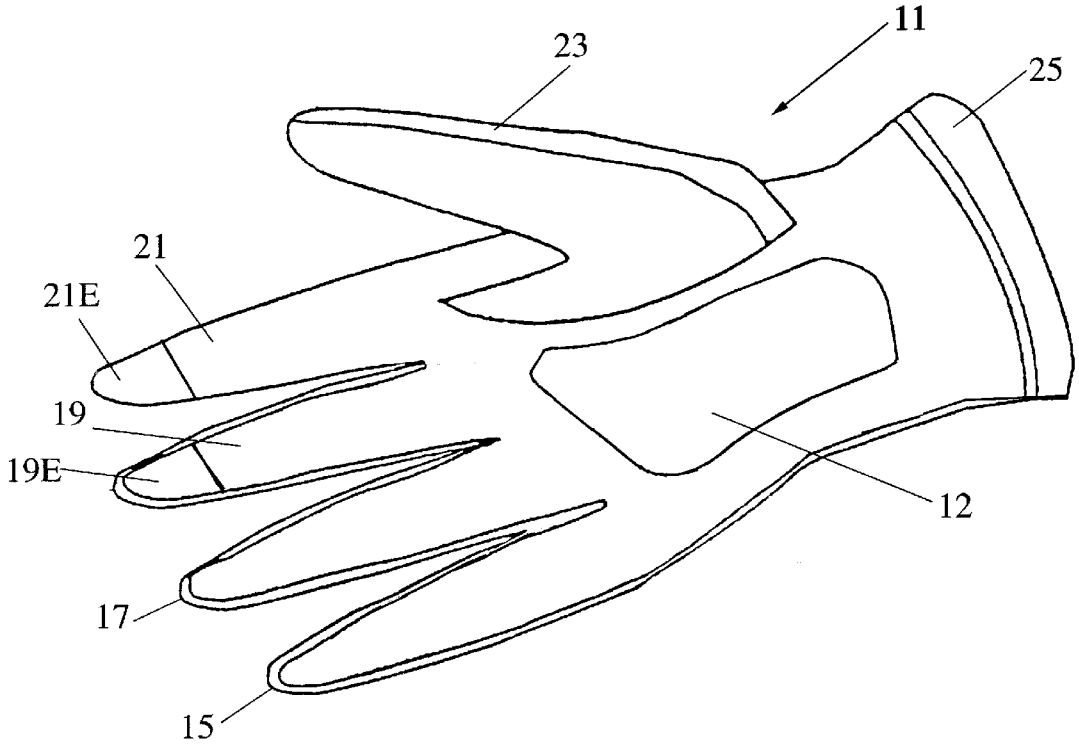

Preferably, the glove 11 has one or more small or large apertures 12 in the back of the glove, shown in FIG. 2, that allow the hand enclosed in the glove to "breathe" and to ventilate any accumulated water vapor that forms from perspiration produced by the enclosed hand. Accumulation of water vapor between the enclosed hand and the glove 11 may cause partial misfunctioning of the first gripping surface and thus adversely affect the function thereof. FIG. 2 also illustrates removal of ends, 19E and 21E, of selected glove fingers to expose the corresponding fingers, for special purpose uses or for further removal of water vapor from the interior of the glove 11.

Preferably, the gripping surfaces on the glove 11 are placed at key pressure regions that may depend upon the application. For example, where the handle 31 is part of a tennis racket, most or all of the entire palm region 13 and finger coverings 15, 17, 19 and 21 should be covered with the gripping surface material because the palm is pressed against the handle in most forehand and backhand strokes. Where the handle 31 is part of a badminton racket, a golf club or an automobile steering wheel, it may be preferable to provide the gripping surface only on the finger coverings 15, 17, 19 and 21, because these are often the key pressure points in these activities.

Figure 3:
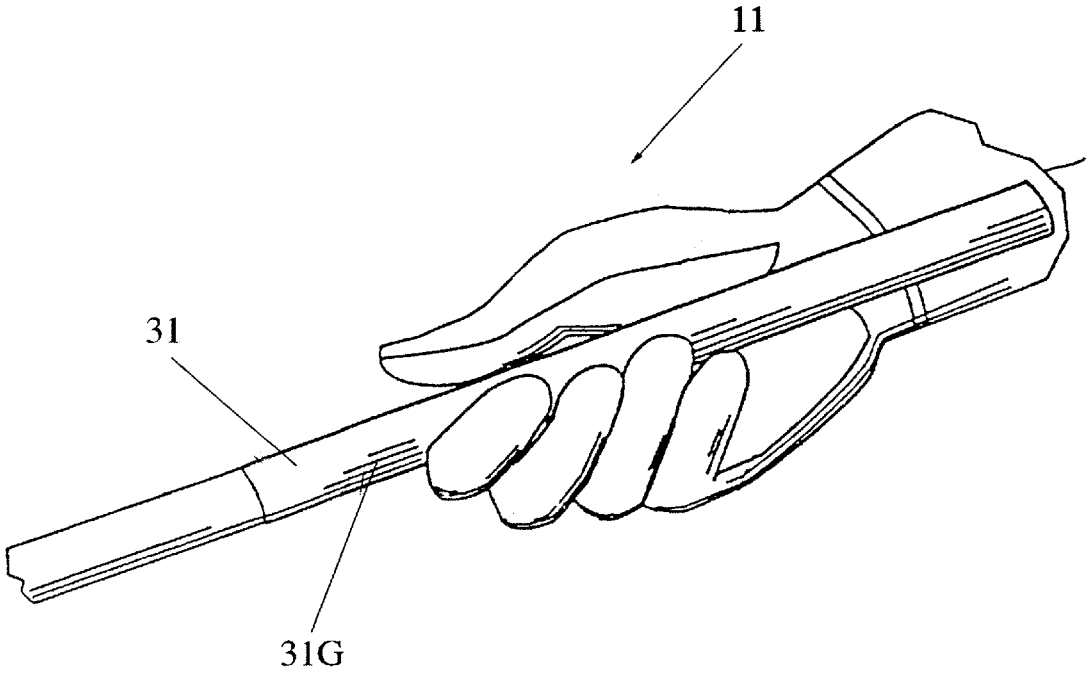
FIG. 3 shows a glove and a handle interacting according to the invention.
Figure 4:
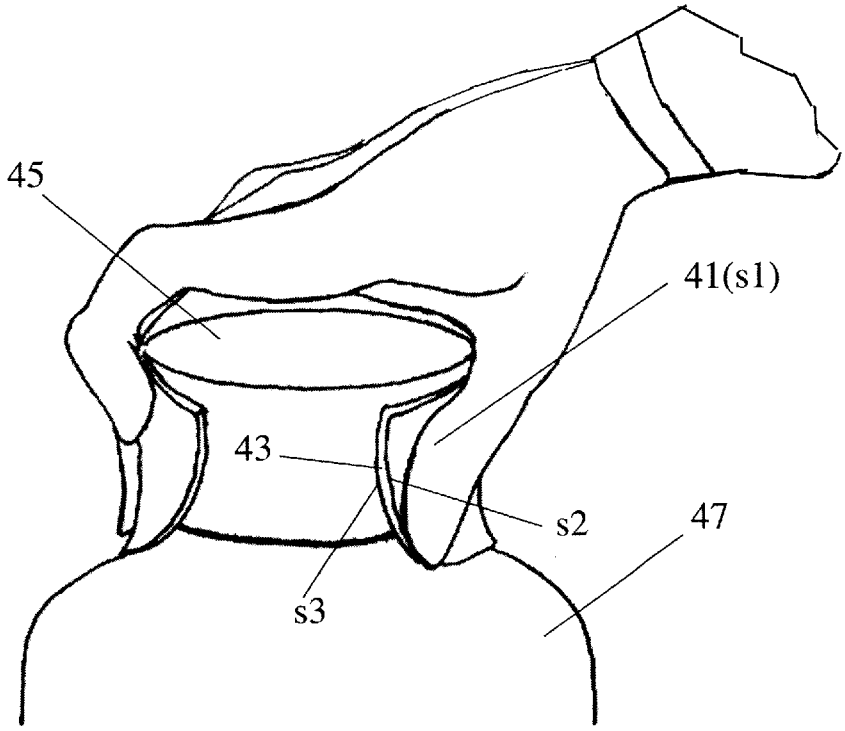
FIG. 4 shows a glove and a flexible band, constructed according to the invention, interacting with another object.

FIG. 3 shows a glove 11 and enclosed hand gripping an implement handle 31 that has a second material M2 thereon that forms a second gripping surface 31G (shaded region). The first and second materials M1 and M2 may be the same or may differ from each other, depending upon the application and the environment in which the invention is used. The portions of the glove 11 that include the first gripping surface(s), for example, 13G and 15G in FIG. 1, are chosen to "mate with" the second gripping surface(s) on the handle 31 so that, when the glove-enclosed hand grips the handle in a natural manner, the first and second gripping surfaces match reasonably closely and form a temporary non-slip join or fastening together. Preferably, this join should resist coming apart by application of a force that is no greater than a selected threshold force $F_{thr}$ that lies in a range of between 5 and 500 psi.

Where the invention is used by a person afflicted with arthritis or a similar disease, the invention includes a glove 41 with a first gripping surface S1 and includes a flexible band 43 of fabric, as shown in FIG. 4, having a second gripping surface S2 on a front side and being wrappable around a first object 45, such as a jar lid, that is to be unscrewed or rotated or otherwise moved relative to a second object 47, such as a jar. Preferably, the flexible band 43 has a third gripping surface S3 on a back side that mates with and grips the surface of the first object 45 (e.g., a jar lid). The glove 41, the flexible band 43 and the first object 45 then form a locked-together entity with improved traction, when the flexible band is wound around the first object and a hand inside the glove grips the flexible band 43. With this arrangement, the first object 45 is more easily moved (e.g., rotated) relative to the second object 47.

The variety of materials M1 and M2 that can be used to provide the non-slip join or temporary/permanent bonding is quite large. Several kinds of thermoplastic materials are suitable here for most environments. These include amorphous polymers and crystalline polymers. An amorphous polymer includes primarily polymer chains that are randomly organized through application of one or more heating and cooling cycles. An amorphous polymer may have no definite melting point but rather a history-dependent melt point or a range of melt points. These polymers can be remelted and resolidified and usually include a basic N-carbon unit ($N \geqq 2$) and a benzene ring, connected together as a polymer unit. Examples of amorphous polymers are acrylonitrile butadiene styrene (ABS), polystyrene (PS), styrene copolymer (SAN) and polycarbonate.

Crystalline polymers have distinct melt points, which are usually higher than the normal range of amorphous polymer melt points. A crystalline polymer is often "tougher" than most amorphous polymers and manifests a greater resistance to attack by chemicals (for example, the compounds produced by human perspiration). Examples of crystalline polymers are acetal, nylon, polyethylene (PET), polypropylene (PP) and various polyesters.

A thermoplastic polymer is often combined with one or more additives that alter the chemical properties of the polymer. These additives may include rubber, glass fibers, mineral fillers, plasticizers, ultraviolet stabilizers, antioxidants and electrically conductive additives. Several of these additives can significantly affect the "gripability" of the basic material.

Another suitable group of gripping materials M1 and M2 includes copolymers, which are mixtures of two or more distinct polymers that have been heated or exposed to a reactive agent that promotes chemical combination of the constituents.

Other materials that may be suitable, depending upon the application, include neoprenes, natural and synthetic rubbers, cellulose compounds, silicone compounds and sandwiched polymer combinations in which two or more distinct polymeric materials form alternating layers.

The material M1 is preferably chosen to allow frequent washing or other cleaning of the glove 11 to remove perspiration, dirt and other undesirable compounds that accumulate on and within the glove material through repeated use. However, where a user does not contemplate frequent washing or cleaning of the glove 11, the material M1 need not be chosen to be washable many times. The material M2 will not be directly exposed to perspiration, and the user has more freedom in the choice of this material, which need not be washed as the glove 11 is washed. Alternatively, the materials M1 and M2 may be chosen to be the same for convenience in manufacture or handling.

The invention can be applied in most sports that require a hand to grip or otherwise manipulate a handle, including golf grips, racquets for tennis, badminton, squash, racquetball and table tennis, jai alai, baseball, cricket, fencing, skiing, bicycling, rowing, hockey, lacrosse, field hockey, fishing, curling, pole vaulting, gymnastics, sailboarding, mountaineering and hang gliding. The invention can also be used in construction, maintenance and control activities, including construction and gardening hand tools, electrical and mechanical tools for use under water or in outer space or in another fluid, and in automobile and motorcycle driving.

What is claimed is:

1. Apparatus for providing an enhanced grip between a gloved hand and an implement handle, the apparatus comprising:

a glove that covers a selected portion of a hand, the glove including at least one selected first gripping surface region that includes a first gripping material on an exposed surface of the glove; and an implement handle, adapted to allow a hand that wears the glove to grip and hold the implement handle, where the implement handle has at least one selected second gripping surface region that includes a second gripping material on an exposed surface of the handle, where the first and second gripping materials are chosen so that, when the hand that wears the glove grips the implement handle, the first gripping surface region on the glove and second gripping surface region on the implement handle form a bond that resists slipping;

wherein at least one of the first gripping material and the second gripping material is a thermoplastic polymer combined with an additive drawn from the class of materials consisting of rubber, glass fibers, mineral fillers, plasticizers, ultraviolet stabilizers, antioxidants and electrically conductive additives.

2. The apparatus of claim 1, wherein said glove has a second region that exposes a selected portion of said hand that wears said glove.

3. The apparatus of claim 2, wherein said selected portion of said glove that exposes said hand exposes a selected portion of at least one finger on said hand.

4. The apparatus of claim 1, wherein at least one of said first gripping material and said second gripping material is drawn from the class of materials consisting of acrylonitrile butadiene styrene, polystyrene, styrene copolymer and polycarbonate.

5. The apparatus of claim 1, wherein at least one of said first gripping material and said second gripping material is drawn from the class of materials consisting of acetal, nylon, polyethylene, polypropylene and polyesters.

6. Apparatus for providing an enhanced grip between a gloved hand and an object to be gripped, the apparatus comprising:

a glove that covers a selected portion of a hand, the glove including at least one selected first gripping surface region that includes a first gripping material on an exposed surface of the glove; and a flexible band of material that surrounds a portion of an object to be gripped, the flexible band having a first gripping side and an opposed second gripping side and having at least one selected second gripping surface region on at least a portion of the first gripping side that includes a second gripping material that faces and mates with the first gripping surface region of the glove, where the first and second gripping materials are chosen so that the first and second gripping materials mate with each other and form a bond that resists slipping;

wherein at least one of the first gripping material and the second gripping material is a thermoplastic polymer combined with an additive drawn from the class of materials consisting of rubber, glass fibers, mineral fillers, plasticizers, ultraviolet stabilizers, antioxidants and electrically conductive additives.

7. The apparatus of claim 6, wherein at least a portion of said second gripping side of said flexible band has a third gripping material that faces said object to be gripped and forms a temporary bond with said object that resists slipping.

8. The apparatus of claim 6, wherein said glove has a second region that exposes a selected portion of said hand that wears said glove.

9. The apparatus of claim 8, wherein said selected portion of said glove that exposes said hand exposes a selected portion of at least one finger on said hand.

10. The apparatus of claim 6, wherein at least one of said first gripping material and said second gripping material is drawn from the class of materials consisting of acrylonitrile butadiene styrene, polystyrene, styrene copolymer and polycarbonate.

11. The apparatus of claim 6, wherein at least one of said first gripping material and said second gripping material is drawn from the class of materials consisting of acetal, nylon, polyethylene, polypropylene and polyesters.

12. The apparatus of claim 6, wherein at least one of said first gripping material and said second gripping material is a thermoplastic polymer combined with an additive drawn from the class of materials consisting of rubber, glass fibers, mineral fillers, plasticizers, ultraviolet stabilizers, antioxidants and electrically conductive additives.

13. Apparatus for providing an enhanced grip between a gloved hand and an object to be gripped, the apparatus comprising:

a glove that covers a selected portion of a hand, the glove including at least one selected first gripping surface region that includes a first gripping material on an exposed surface of the glove; and a flexible band of material that surrounds a portion of an object to be gripped, the flexible band having a first gripping side and an opposed second gripping side and having at least one selected second gripping surface region on at least a portion of the first gripping side that includes a second gripping material that faces and mates with the first gripping surface region of the glove, where the first and second gripping materials are chosen so that the first and second gripping materials mate with each other and form a bond that resists slipping;

where at least a portion of the second gripping side of the flexible band has a third gripping material that faces the object to be gripped, that forms a temporary bond with the object that resists slipping when a gripping force is applied to the object, and that releases from the object when the gripping force is removed, and where at least one of the first gripping material and the second gripping material is drawn from the class of materials consisting of acrylonitrile butadiene styrene, polystyrene, styrene copolymer, polycarbonate and rubber.

14. Apparatus for providing an enhanced grip between a gloved hand and an object to be gripped, the apparatus comprising:

a glove that covers a selected portion of a hand, the glove including at least one selected first gripping surface region that includes a first gripping material on an exposed surface of the glove; and a flexible band of material that surrounds a portion of an object to be gripped, the flexible band having a first gripping side and an opposed second gripping side and having at least one selected second gripping surface region on at least a portion of the first gripping side that includes a second gripping material that faces and mates with the first gripping surface region of the glove, where the first and second gripping materials are chosen so that the first and second gripping materials mate with each other and form a bond that resists slipping;

where at least a portion of the second gripping side of the flexible band has a third gripping material that faces the object to be gripped, that forms a temporary bond with the object that resists slipping when a gripping force is applied to the object, and that releases from the object when the gripping force is removed, and where at least one of the first gripping material and the second gripping material is a thermoplastic polymer combined with an additive drawn from the class of materials consisting of rubber, glass fibers, mineral fillers, plasticizers, ultraviolet stabilizers, antioxidants and electrically conductive additives.

* * * * *